US006044592A

United States Patent [19]

Strieter

[11] Patent Number: 6,044,592

[45] **Date of Patent: *Apr. 4, 2000**

[54] NEST OF CURBS

[75] Inventor: Joel W. Strieter, Louisville, Ky.

[73] Assignee: Kentuckiana Curb Company, Louisville, Ky.

[ * ] Notice: This patent is subject to a terminal disclaimer.

[21] Appl. No.: 09/076,991

[22] Filed: May 13, 1998

Related U.S. Application Data

[63] Continuation-in-part of application No. 08/671,326, Jun. 27, 1996, Pat. No. 5,791,092.

[51] Int. Cl.[7] ..... F16M 11/00

[52] U.S. Cl. ..... 52/27; 52/200; 248/237; 248/678

[58] Field of Search ..... 52/27, 72, 173.1, 52/200, 292, 592.6, 648.1, 651.11, 653.1, 656.1, DIG. 16, 219; 62/259.1, DIG. 16; 248/174, 237, 676, 678; 206/505

[56] References Cited

U.S. PATENT DOCUMENTS

| | | | |
|---|---|---|---|
| 1,021,782 | 4/1912 | Klein | 52/72 |
| 3,742,659 | 7/1973 | Drew | 52/27 X |
| 3,749,908 | 7/1973 | Esser et al. | 52/200 X |
| 3,878,655 | 4/1975 | Toth et al. | 52/27 |
| 3,896,595 | 7/1975 | Anghinetti et al. | 52/72 X |
| 3,903,340 | 9/1975 | Shepherd | 52/DIG. 16 X |
| 4,399,975 | 8/1983 | Trimarco et al. | 248/678 |
| 4,413,450 | 11/1983 | Brower | 52/27 |
| 4,428,166 | 1/1984 | Burghart | 52/72 X |
| 4,598,503 | 7/1986 | Berger et al. | 52/27 |
| 4,895,066 | 1/1990 | Carnahan | 62/259.1 X |
| 5,016,406 | 5/1991 | Calam et al. | 52/200 X |
| 5,188,333 | 2/1993 | Schumacher et al. | 248/676 |
| 5,297,371 | 3/1994 | Borghetto | 52/200 X |
| 5,465,533 | 11/1995 | Rummo, Jr. et al. | 248/676 X |
| 5,791,092 | 8/1998 | Strieter | 52/27 |

*Primary Examiner*—Carl D. Friedman
*Assistant Examiner*—Kevin D. Wilkens
*Attorney, Agent, or Firm*—Norman Rainer

[57] ABSTRACT

A number of specially shaped curbs for roof-top mounting of equipment are disposed in a nested array which occupies less shipping space than ordinary curbs normally shipped in stacked relationship, one atop the other. Each curb is constructed from four side walls joined at their side edges to produce a box-like structure. The curb has upper and lower rectangular perimeters, the upper perimeter being smaller in each rectangular dimension than the lower perimeter.

10 Claims, 2 Drawing Sheets

NEST OF CURBS

RELATED APPLICATIONS

This application is a continuation-in-part of U.S. patent application Ser. No. 08/671,326, filed Jun. 27, 1996 issued Aug. 11, 1998 as U.S. Pat. No. 5,791,092.

BACKGROUND OF THE INVENTION

1. Field of the Invention

This invention concerns a support, generally referred to as a "curb," for placement upon the roof of a building, and upon which a piece of equipment such as an air conditioning unit is mounted. The invention more particularly relates to a nested array of a multitude of said curbs.

2. Description of the Prior Art

Curb devices are in commonplace use for supporting air conditioning units and other equipment upon a built-up roof, i.e., a roof having a water barrier layer such as asphalt, tar paper, etc. The curb is a box-like structure, generally fabricated of sheet metal or fiberglass panels, and is preferably installed on the roof during initial roof construction.

The relatively large size of the curb results in high cost for shipment between the curb manufacturing location and the sales or use location. The particular reason for the high transportation expense is that the curbs, even if neatly stacked one atop another, occupy considerable space which could otherwise be utilized for more valuable cargo. Because the curbs are relatively low cost items, higher shipping charges produce a significant percentage-wise increase in the delivered cost of the curb.

It is accordingly an object of the present invention to provide a new manner of association of a multitude of curbs whereby said curbs occupy less shipping space than the same number of curbs disposed in conventional manner for shipping.

It is another object of this invention to provide a curb which facilitates the aforesaid new manner of association.

These objects and other objects and advantages of the invention will be apparent from the following description.

SUMMARY OF THE INVENTION

The above and other beneficial objects and advantages are accomplished in accordance with the present invention by a nested array of a multitude of curbs, each of said curbs comprising:

a) four side walls joined to form a box-like structure having an interior region, said side walls having interior and exterior surfaces and upper and lower extremities which define upper and lower rectangular perimeters, respectively, disposed in spaced apart parallel relationship, said upper perimeter being smaller in each rectangular dimension than said lower perimeter, said curb having a plane of symmetry that perpendicularly bisects two opposed side walls, b) a crown flange associated with said upper perimeter and adapted to be disposed in a horizontal plane, and c) an outwardly directed base flange associated with said lower perimeter and adapted to rest upon a roof, d) said nested array characterized in that a first curb of said multitude telescopically enters the interior region of a next successive curb to an extent where the base flanges of said curbs are in close parallel adjacency, and the remaining curbs are added in the same telescoping manner.

In some embodiments, the crown and base flanges of each curb are disposed in parallel relationship. In other embodiments, the base flange is angled with respect to the crown flange in order to accommodate a sloped roof.

BRIEF DESCRIPTION OF THE DRAWING

For a fuller understanding of the nature and objects of the invention reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
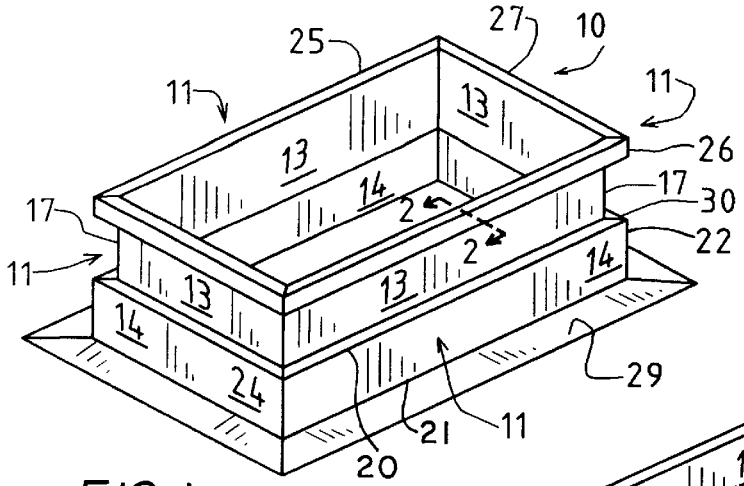
FIG. 1 is a perspective view of a first embodiment of a curb suitable for producing the nested array of the present invention.
Figure 5:
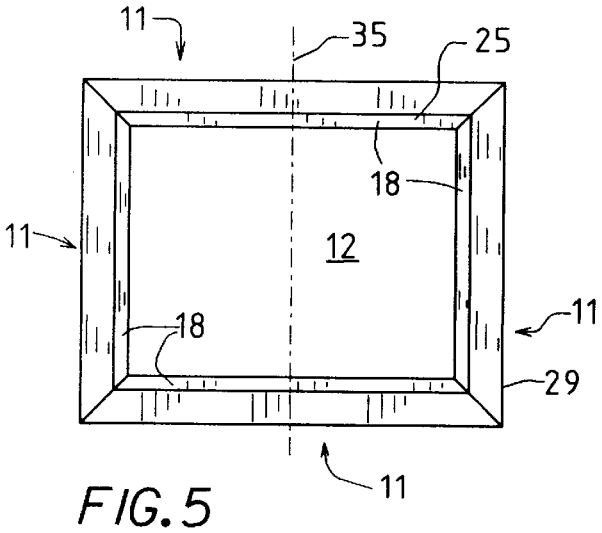
FIG. 5 is a top plan view of the curb of FIG. 1.
Figure 2:
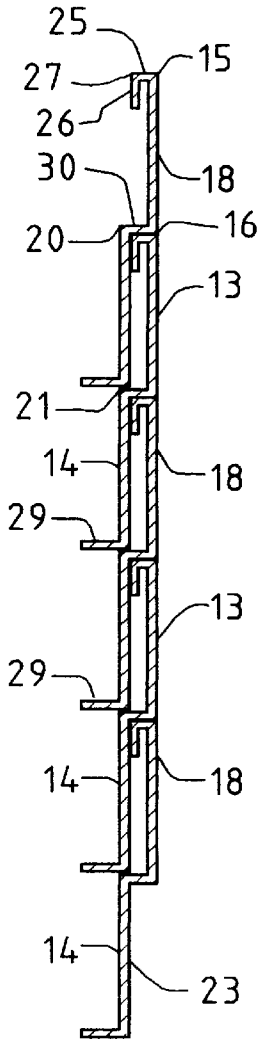
FIG. 2 is an enlarged fragmentary sectional view taken in the direction of the arrows upon lines 2—2 of FIG. 1 and showing a multitude of identical curbs of FIG. 1 in a nested array.

Referring to FIGS. 1, 2, and 5, a first embodiment of a curb 10 suitable for producing the nested array of the present invention is shown comprised of four side walls 11 joined to form a rectangular box-like structure having an interior region 12.

Side walls 11 of said first embodiment are adapted to be vertically positioned, and are comprised of upper and lower panels 13 and 14, respectively, which are disposed in parallel planes. Upper panels 13 are bounded by straight top and bottom extremities 15 and 16, respectively, and opposed straight side edges 17, producing a rectangular perimeter. Said upper panels are further characterized in having interior and exterior surfaces 18 and 19, respectively. The four upper panels 13 are joined at their side edges 17, thereby forming vertically oriented corners of the curb.

Figure 4:
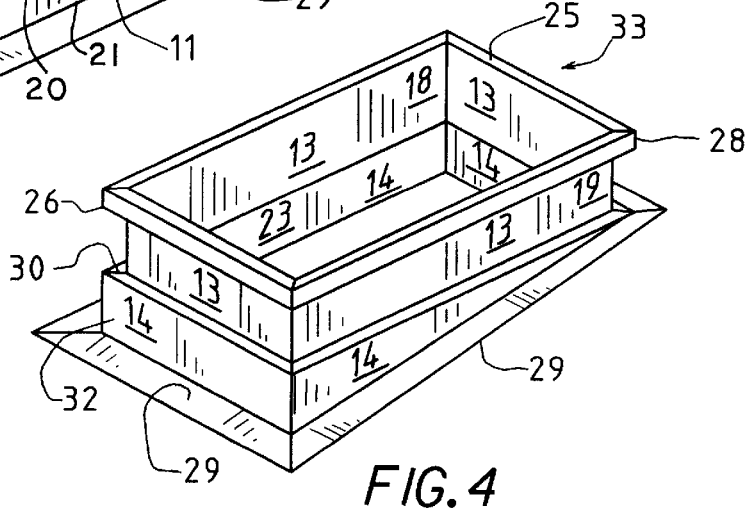
FIG. 4 is a perspective view of a second embodiment of a curb suitable for producing the nested array of this invention.

Lower panels 14 are bounded by straight top and bottom extremities 20 and 21, respectively, and opposed straight side edges 22, and are further characterized in having interior and exterior surfaces 23 and 24, respectively. Lower panels 14 are disposed outwardly from said interior region with respect to the corresponding upper panels 13 by a distance which may range between about 1 and 3 inches. Said four lower panels are joined at their side edges 22 to form vertically oriented corners. Although said lower panels may have a rectangular perimeter, certain embodiments may have a bottom extremity that is angled with respect to the corresponding top extremity, as shown in FIG. 4. Said upper and lower panels are preferably of sheet metal construction.

Figure 7:
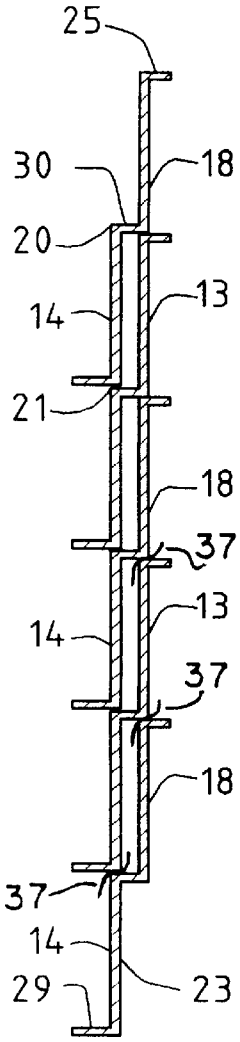
FIG. 7 is a fragmentary vertical sectional view of a nested array comprised of a third embodiment of curb.

An outwardly directed crown flange 25 is associated with the top extremities of upper panels 13 of the embodiment of FIG. 1. Said crown flange is essentially a planar rectangular strip of constant width that surrounds side walls 11, and is adapted to be horizontally positioned. The function of said crown flange is to securely support equipment such as air conditioning components. Said crown flange may accordingly have, or be made to have, apertures to receive securing bolts. The crown flange is preferably an integral extension of the corresponding upper panel, having been formed substantially by way of a bending operation. In the third embodiment of the curb of this invention, as shown in FIG. 7, crown flange 25 is inwardly directed.

A downwardly directed lip 26 is often associated with the distal edge 27 of crown flange 25 as a continuous integral extension having been formed by bending. The lips 26 associated with the four upper panels are joined as by welding at their lateral extremities 28. The function of lip 26 is to add strength to the curb structure and to provide a flashing surface which keeps water from dripping directly onto the lower portions of the curb.

An outwardly directed base flange 29 is associated with the bottom extremities of lower panels 14 as a surrounding planar rectangular strip of uniform width. Said base flange, which may be formed by way of bending, is orthogonally disposed to said lower panels. The embodiment of the curb shown in FIG. 1 has parallel crown and base flanges. Although generally intended for use on flat roofs, such embodiment can also be employed on sloped roofs, but in which case the equipment supported by the curb will not be horizontally disposed. In the second embodiment of the curb of this invention shown in FIG. 4 and adapted for use on a sloped roof, the base flange is angled with respect to the crown flange. The function of the base flange is to facilitate securement to an underlying roof structure.

In the aforementioned curb embodiments, an outwardly directed shoulder 30 extends in joinder between the bottom extremities 16 of upper panels 13 and the top extremities 20 of lower panels 14. Said shoulder is a planar strip of constant width that encircles the four sidewalls 11 in parallel disposition to crown flange 25 at a location which is half way between said crown and base flanges. The width of the shoulder, measured orthogonally to sidewall 11, is slightly greater than the similarly measured width of the crown flange. The overall construction of the curb is such as to possess at least one plane of symmetry, represented by broken line 35 in FIG. 5, said plane of symmetry perpendicularly bisecting opposed sidewalls 11.

By virtue of the aforesaid critically selected features of curb construction, a multitude of curbs can be disposed in nested relationship, as shown in FIG. 2. In achieving the nested state, that portion of the interior of a curb which is associated with said lower panels slides in sleeve-like fashion over the exterior of the upper panel portion of the next lower curb. When nested, the shoulder of one curb rests in abutment with the crown flange of the next lower curb.

Figure 6:
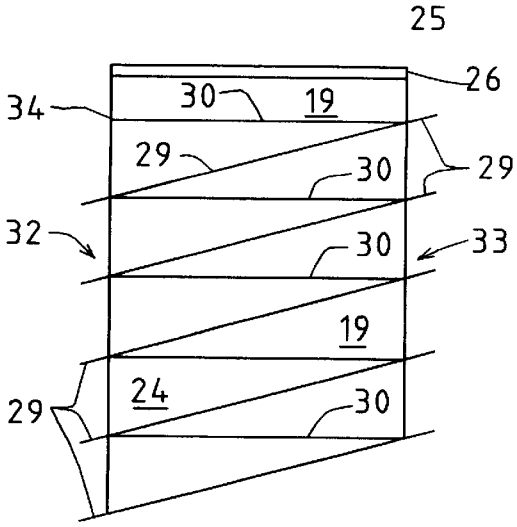
FIG. 6 is a side view of a nested array produced from the curb embodiment of FIG. 4.
Figure 3:
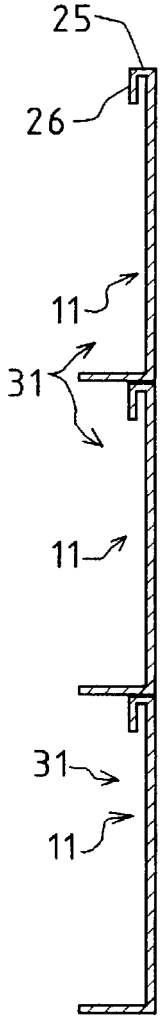
FIG. 3 PRIOR ART
FIG. 3 is a view similar to FIG. 2 showing a series of prior art curbs in stacked relationship.

Conventional curbs 31 of the prior art, when stacked as shown in FIG. 3 rest one atop another. By way of comparison, nests of curbs of this invention, as shown in FIGS. 2, 6 and 7, occupy only about half the space of the comparable stack of conventional curbs shown in FIG. 3. For ease of comparison, features of the prior art curbs of FIG. 3 are denoted by the same numerals as corresponding features of curbs useful in the present invention.

It is to be noted that the nest of curbs of FIG. 2 is such that the exterior is comprised of base flanges 29, and except for the uppermost curb, lower panels 14. The interior of the nest, except for the lowermost curb, is comprised entirely of upper panels 13.

In the sloped curb embodiment of FIG. 4, the tallest wall 32, measured vertically between the corresponding crown and base flanges within said plane of symmetry, is considered to be a front side wall. In such embodiments, shoulder 30 is at the mid-height location of said front side wall, and extends to a rear side wall 33 in parallel juxtaposition to crown flange 25. In the nested state of sloped curbs, shown in FIG. 6, portions of the upper panels are apparent on the exterior of the nest. For transportation purposes, the lowermost extremity of the nest of FIG. 6 may be shored to compensate for the angled configuration of the nest. Alteratively, the nest may be transported in an upside down state whereby the crown flange of the first curb in the nest rests upon the floor of the transporting vehicle.

Figure 8:
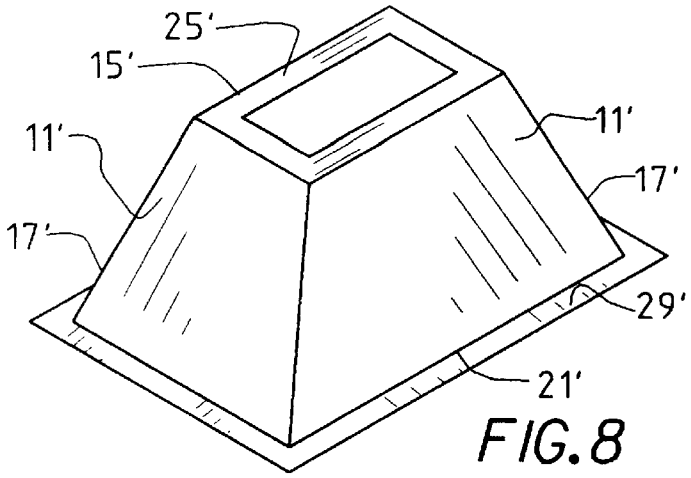
FIG. 8 is a perspective view of a fourth embodiment of curb suitable for producing the nested array of this invention.

The fourth exemplified embodiment of curb useful in producing a nested array, as shown in FIG. 8, is comprised of four tapered sidewalls 11' having opposed straight side edges 17' and straight upper and lower extremities 15' and 21', respectively. The width of sidewalls 11', measured between said side edges 17', diminishes uniformly in going from lower extremity 21' to upper extremity 15 having crown flange 25'. Such construction is characterized by a pyramidal shape wherein the sidewalls are inclined toward said interior region in going from said lower to upper extremities.

Figure 9:
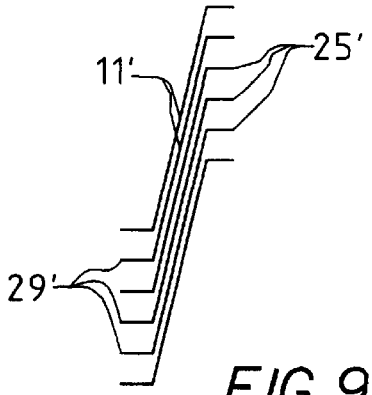
FIG. 9 is a fragmentary vertical sectional view of a nested array produced from the curbs of FIG. 8.

In general, the degree of compactness of the nested array, namely the diminished height of the array in comparison with a stack of curbs one atop another as found in the prior art, is dependent upon the configuration of the side walls and crown flange. For example, the degree of compactness of the arrays of FIGS. 2 and 7 is about 50% because two of the nested curbs occupy only about 50% of the combined vertical heights of both curbs standing alone or stacked. In the case of the array of FIG. 9, a degree of compactness of about 72% is achieved. In general, the present invention provides for a degree of compactness between 40% and 75%. The height of the array is measured vertically from the base flange of the lowermost curb to the crown flange of the uppermost curb. The number of curbs in each nested array may range from about 3 to 10. Release means are preferably associated with or interleaved with the curbs of the nested array to facilitate nesting and removal of the individual curbs. Suitable release means include sheet materials 37 that may be disposed upon interior edges associated with said crown and base flange.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A nested array of a multitude of curbs bounded by uppermost and lowermost curbs, each of said curbs comprising:

a) four side walls joined to form a box-like structure having an interior region, said side walls having interior and exterior surfaces and upper and lower extremities which define upper and lower rectangular perimeters, respectively, disposed in spaced apart parallel relationship, said upper perimeter being smaller in each rectangular dimension than said lower perimeter, said curb having a plane of symmetry that perpendicularly bisects two opposed side walls, b) a crown flange associated with said upper perimeter and adapted to be disposed in a horizontal plane, and c) an outwardly directed base flange associated with said lower perimeter and adapted to rest upon a roof, d) said nested array characterized in that a first curb of said multitude telescopically enters the interior region of a next successive curb to an extent where the base flanges of said curbs are in close parallel adjacency, and the remaining curbs are added in the same telescoping manner.

2. The nested array of claim 1 wherein said crown flange is outwardly directed with respect to said interior region.

3. The nested array of claim 1 wherein said crown flange is inwardly directed toward said interior region.

4. The nested array of claim 1 having a degree of compactness between 40% and 75%.

5. The nested array of claim 1 wherein the curbs of said multitude are identical.

6. The nested array of claim 1 having release means interleaved with said curbs to facilitate nesting and removal of said curbs.

7. The nested array of claim 1 wherein said sidewalls, where they are joined, are bounded by side edges, thereby producing four corners.

8. The nested array of claim 7 wherein said side edges are straight.

9. The nested array of claim 7 wherein said sidewalls are of a tapered configuration wherein the width of each sidewall, measured between the side edges, diminishes uniformly in going from said base flange to said crown flange.

10. The nested array of claim 9 having a pyramidal shape wherein said sidewalls are inclined toward said interior region in going from said lower to upper extremities.

* * * * *